US007810648B2

(12) United States Patent
Takev et al.

(10) Patent No.: US 7,810,648 B2
(45) Date of Patent: Oct. 12, 2010

(54) SCREEN ASSEMBLY FOR SEPARATING MATERIAL ACCORDING TO PARTICLE SIZE

(75) Inventors: Dieter Takev, St. Catharines (CA); Florian Festge, Niagara-On-The-Lake (CA); Rudiger Heinrich, Fenwick (CA)

(73) Assignee: Tylinter, Inc., Mentor, OH (US)

( * ) Notice: Subject to any disclaimer, the term of this patent is extended or adjusted under 35 U.S.C. 154(b) by 594 days.

(21) Appl. No.: 11/820,808

(22) Filed: Jun. 21, 2007

(65) Prior Publication Data

US 2008/0011652 A1 Jan. 17, 2008

Related U.S. Application Data

(60) Provisional application No. 60/815,403, filed on Jun. 21, 2006.

(51) Int. Cl.
*B07B 1/42* (2006.01)

(52) U.S. Cl. ..... 209/369; 209/364

(58) Field of Classification Search ..... 209/364, 209/365.1, 365.2, 365.3, 365.4, 366, 366.5, 209/367, 368, 369; 384/457
See application file for complete search history.

(56) References Cited

U.S. PATENT DOCUMENTS

| | | | |
|---|---|---|---|
| 2,009,219 | A | 7/1935 | Blackburn |
| 2,225,444 | A | 12/1940 | Gary |
| 2,230,316 | A | 2/1941 | Wolz |
| 2,335,425 | A | 11/1943 | Kouyoumjian |
| 2,509,769 | A | 5/1950 | Hirst |
| 2,659,487 | A | 11/1953 | Caler |
| 2,821,292 | A | 1/1958 | Spurlin |
| 3,003,635 | A | 10/1961 | Wood |
| 3,347,373 | A | 10/1967 | Dahlberg |
| 3,473,396 | A | 10/1969 | Schwake |
| 4,486,302 | A | 12/1984 | Jorgensen |
| 4,661,245 | A | 4/1987 | Rutherford et al. |
| 4,819,810 | A | 4/1989 | Hoppe |
| 4,839,036 | A | 6/1989 | Slesarenko |
| 4,960,510 | A | 10/1990 | Wolff |
| 5,341,939 | A | 8/1994 | Aitchison et al. |
| 5,361,911 | A | 11/1994 | Waites, Sr. et al. |
| 5,377,846 | A | 1/1995 | Askew |
| 5,735,409 | A | 4/1998 | Malmberg |

(Continued)

FOREIGN PATENT DOCUMENTS

| | | |
|---|---|---|
| DE | 4140210 | 6/1993 |

(Continued)

*Primary Examiner*—John Q Nguyen
*Assistant Examiner*—Mark Hageman
(74) *Attorney, Agent, or Firm*—McDonald Hopkins LLC

(57) ABSTRACT

The present invention provides a screen assembly having a base, a screen box having a screen medium and a pair of mutually opposed bearings, a shaft having a pair of eccentric journals that are rotatably supported in the respective pair of mutually opposed bearings, and at least one articulated suspension assembly having a first leg having a first torsion joint and a second torsion joint, a second leg having a third torsion joint and a fourth torsion joint, and a third leg having a first end pivotably secured to the second torsion joint and a second end pivotably secured to the third torsion joint, for pivotally interconnecting the screen box and the base to dampen vibrations.

15 Claims, 5 Drawing Sheets

U.S. PATENT DOCUMENTS

| | | | | | |
|---|---|---|---|---|---|
| 5,829,599 | A | | 11/1998 | Woodgate | |
| 5,868,259 | A | * | 2/1999 | Bielagus | 209/674 |
| 5,899,340 | A | * | 5/1999 | MacNaughton | 209/325 |
| 5,984,107 | A | | 11/1999 | Bleh | |
| 6,003,682 | A | * | 12/1999 | Bielagus | 209/674 |
| 6,082,551 | A | * | 7/2000 | Kai | 209/307 |
| RE38,303 | E | | 11/2003 | Askew | |
| 6,827,223 | B2 | | 12/2004 | Colgrove et al. | |
| 6,889,846 | B2 | | 5/2005 | Olsen et al. | |
| 6,957,741 | B2 | | 10/2005 | Freissle et al. | |
| 6,988,624 | B2 | * | 1/2006 | MacNaughton | 209/420 |
| 7,445,121 | B2 | * | 11/2008 | Mainin et al. | 209/365.2 |

FOREIGN PATENT DOCUMENTS

| | | |
|---|---|---|
| GB | 2037618 | 7/1980 |

* cited by examiner

SCREEN ASSEMBLY FOR SEPARATING MATERIAL ACCORDING TO PARTICLE SIZE

CROSS-REFERENCE TO RELATED APPLICATIONS

This application claims priority from U.S. Provisional Patent Application No. 60/815,403 entitled "Suspended Double Eccentric Screen," filed on Jun. 21, 2006, which is hereby incorporated by reference herein.

FIELD OF THE INVENTION

This invention relates to a screen assembly for separating materials and, more particularly, to a screen assembly that prevents the vibrations from reaching the structural support.

BACKGROUND OF THE INVENTION

Screens are used in the aggregate business for separating rock, crushed rock, gravel, sand, and the like (herein referred to as "material") into various sizes. Screens typically comprise one or more screen decks containing a perforated screening medium that acts as a sieve, through which the material is separated. A charge of material is deposited on the receiving end of the screen deck and, as the material is conveyed to the discharge end, smaller material falls through the openings, leaving the larger material retained on the screen deck.

Screens generally use a vibrating mechanism to assist in the separation process, as well as in the conveyance of the material towards the discharge end. The assembly typically includes a screen box having a screen deck and a common frame. Generally, the screen box is vibrated by a vibrating mechanism that is coupled to the common frame. The vibratory motion promotes stratification in the material bed, bringing the smaller material down to the screening medium surface to pass through the openings.

Vibrating mechanisms may be characterized by the form of the vibration and the number of bearings used in the mechanism. Vibrating mechanisms may produce motions that include circular, elliptical, and straight-line reciprocal movement. For example, a suspended double eccentric screen utilizes a counter weight on a shaft to vibrate the screen box, and consequently the screen deck, in a circle-throw motion. The material is propelled toward the discharge end by the motion of the vibrating mechanism.

Typically, the screen box for a suspended double eccentric screen is isolated from the support structure by coil springs, rubber buffers, or shear rubber mounts. Such support systems are costly and require a great deal of space, which may restrict maintenance access. In addition, such mounts generally have a high tolerance in shear rates and do not sufficiently restrict lateral movements that can damage machinery components such as bearings and shafts. Further, conventional springs often break in corrosive environments and on overloading. Therefore, there is a need for a screen and support system that allows a more cost-effective design, is easier to maintain, requires less space, has a longer service life, and restricts lateral movements in the support system.

Additional information will be set forth in the description that follows, which will be obvious in part from the description or may be learned by practice of the invention.

SUMMARY OF THE INVENTION

A screen assembly for separating material according to particle size is provided. The screen assembly may have a base, a screen box having a screen medium and a pair of mutually opposed bearings, a shaft having a pair of eccentric journals that are rotatably supported in the respective pair of mutually opposed bearings. The shaft is rotatable about its axis to vibrate the screen box. At least one articulated suspension assembly having a first leg having a first torsion joint and a second torsion joint, a second leg having a third torsion joint and a fourth torsion joint, and a third leg having a first end pivotably secured to the second torsion joint and a second end pivotably secured to the third torsion joint, pivotally interconnects the screen box and the base so that the first torsion joint is pivotally secured to the screen box and the fourth torsion joint is pivotally secured to the base so that vibrations acting upon the screen box are dampened so that substantially no vibrational forces are transmitted to the base.

DESCRIPTION OF THE DRAWINGS

Operation of the invention may be better understood by reference to the following detailed description taken in connection with the following illustrations, wherein.

DETAILED DESCRIPTION

While the present invention is described with reference to the embodiments described herein, it should be clear that the present invention should not be limited to such embodiments. Therefore, the description of the embodiments herein is illustrative of the present invention and should not limit the scope of the invention as claimed.

Figure 1:
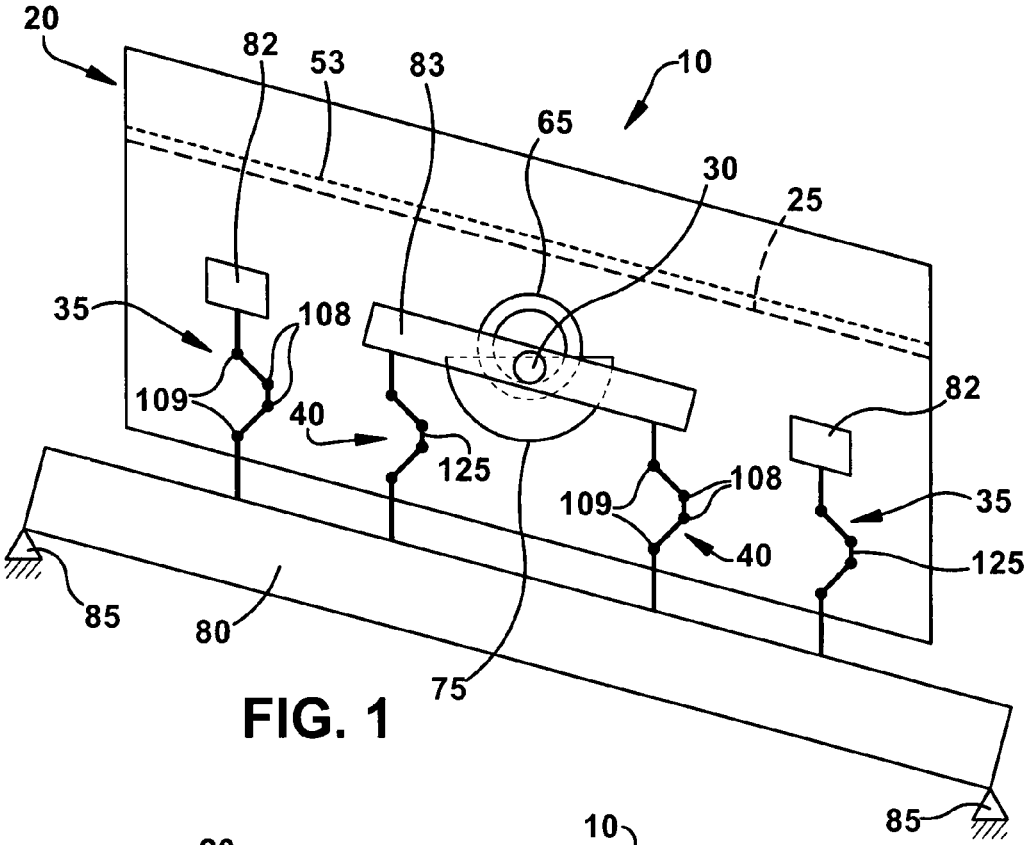
FIG. 1 is a side view of a suspended double eccentric screen with an articulated suspension assembly.

Reference will now be made in detail to the embodiments of the invention, as illustrated in the accompanying figures. Embodiments of a screen assembly 10 are shown in FIGS. 1 through 7. As shown in FIG. 1, the screen assembly 10 generally has a screen box 20, a double eccentric shaft 30, and an articulated suspension assembly 35, 40.

Figure 2A:
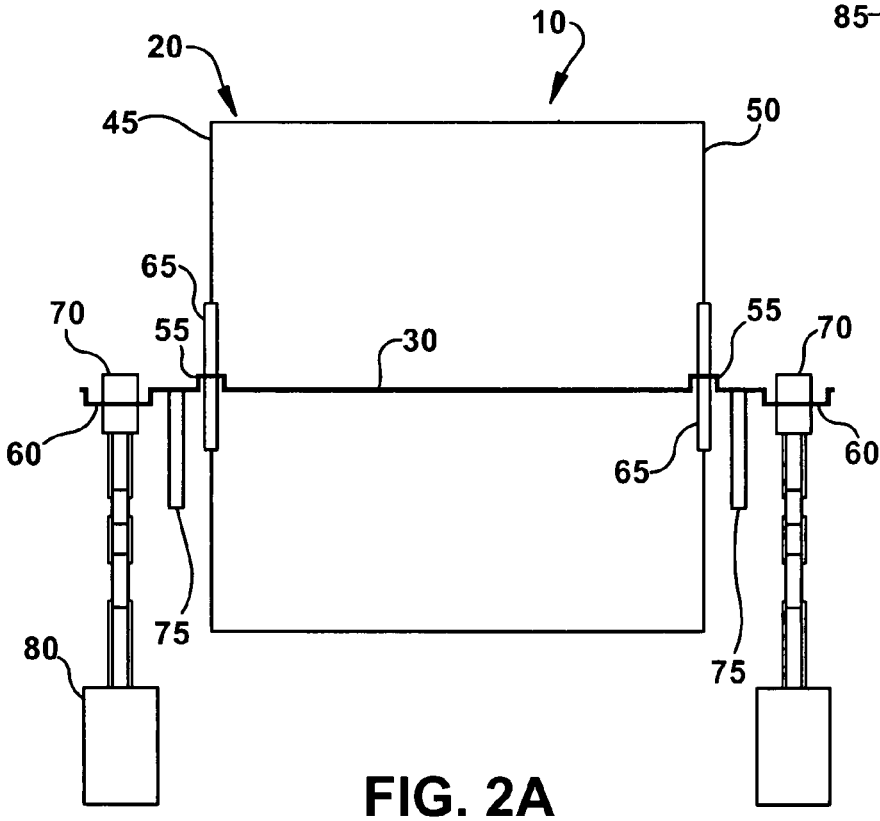
FIG. 2A is an end view of the suspended double eccentric screen of FIG. 1.

As shown in FIG. 2A, the screen box 20 is a rigid frame having substantially vertical side walls 45, 50. The side walls 45, 50 may be positioned substantially parallel to each other and may extend longitudinally along the screen assembly 10. As shown in FIG. 2A, a screen deck 25 extends between the side walls 45, 50 and longitudinally along the length of the screen assembly 10. In one embodiment, the screen deck may extend substantially horizontally between the side walls 45, 50. A screen medium 53 may be connected to and/or secured to the screen deck 25. The screen deck 25 may be cambered to permit proper screen medium tensioning. The screen box 20 (or screen deck 25) may have components, such as buffer strips, to increase the life of the screen medium 53. The screening medium 53, such as woven cloth or perforated plates, contains a plurality of openings of predetermined sizes for screening material according to particle size. The screen medium 53 may define an array of sieve-like openings of a predetermined size for allowing material up to a predetermined size to pass through the screen medium 53.

It is understood that a plurality of screen decks 25 may be used in a stacked arrangement in the screen box 20, one above the other, to separate material into multiple sizes. In one embodiment (not shown), a three-deck screen may be provided with an upper, middle, and lower screen deck, the upper screen deck having the largest openings, the middle screen deck having smaller openings, and the lower screen deck having the smallest openings. In such embodiments, the larger material is retained on the upper screen deck and removed from the screen deck at the upper discharge end. Likewise, the medium-sized material is retained on the middle screen deck and removed from the screen deck at the middle discharge end, the smaller size material is retained on the lower screen deck and removed from the screen deck at the lower discharge end, and the smallest material is deposited below the lower screen deck.

Figure 3:
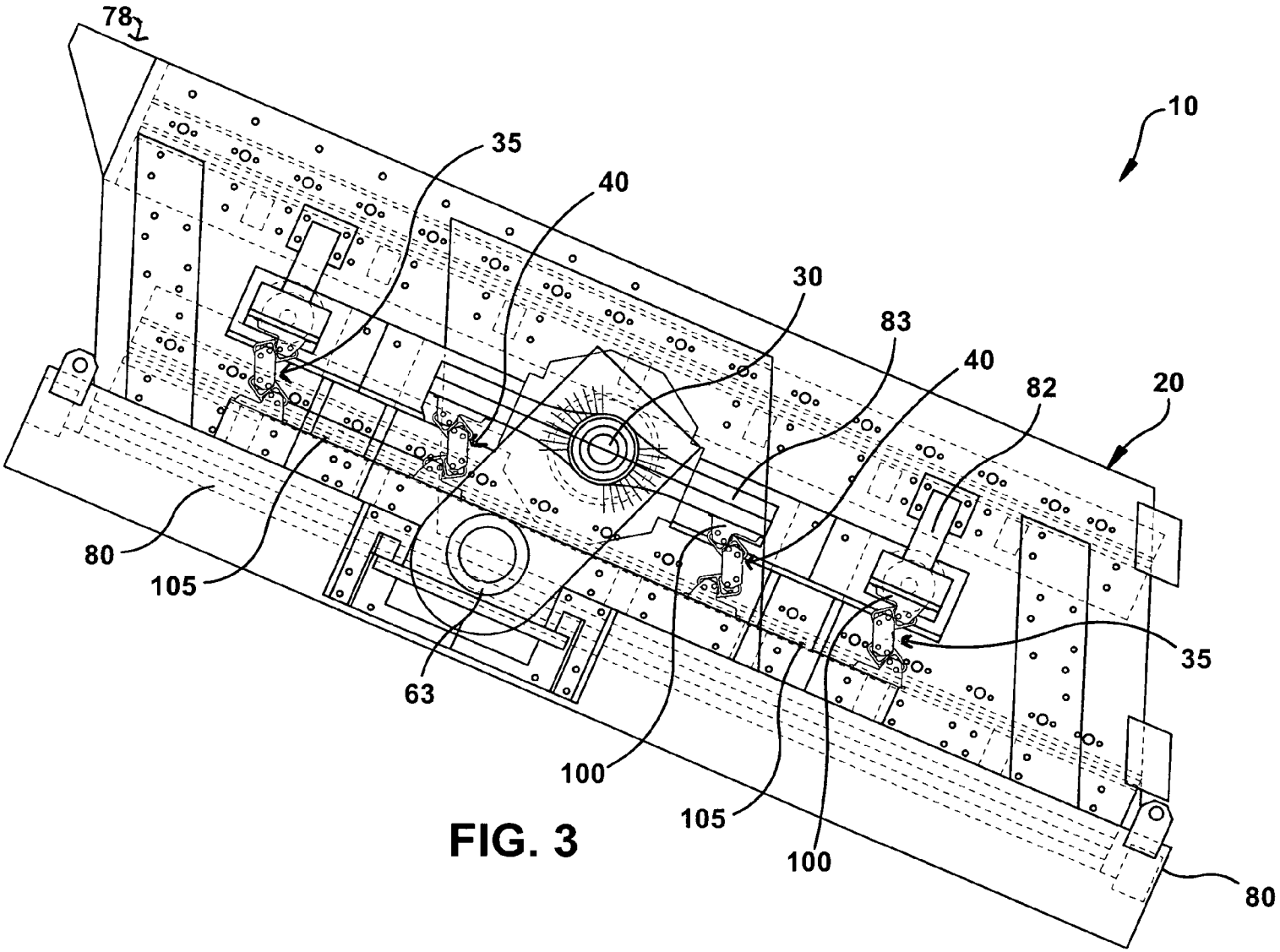
FIG. 3 is a side perspective view of the suspended double eccentric screen with an articulated suspension assembly.

As best shown in FIG. 2A, the screen assembly 10 is provided with a shaft 30 for imparting vibrational movement to the screen box 20. The shaft 30 may be double eccentric, meaning that journals 55, 60 are offset from the centerline of the shaft 30. As shown in FIG. 2A, journals 55 are positioned between journals 60 along shaft 30. As shown in FIG. 3, a drive 63, such as an electric motor, may be secured to either sidewall 45, 50, or the base 80. In some embodiments, the drive 63 may be coupled to the shaft 30 with a belt to rotate the shaft 30.

As shown in FIG. 2A, the shaft 30 may be rotatably supported by bearings 65 and 70. Bearings 65 are secured to the side walls 45, 50 and rotatably support the shaft 30 at journals 55. Bearings 70 are positioned separate from screen box 20 and rotatably support the shaft 30 at outer journals 60. It is understood that bearings 65, 70 may be spherical roller bearings having inner races fitted to the journals 55, 60 and outer races secured in housings, such as cast ductile iron bearing housings. Bearing seals may be provided to prevent grit or other foreign matter from reaching the bearings 65, 70. Accordingly, bearings 65, 70 allow the shaft 30 to rotate in the bearings 65, 70 instead of sliding, so that the shaft 30 is not as inhibited by friction.

One or more balance (or fly) wheels 75 may be provided on shaft 30 to balance the screen assembly 10. In one embodiment, the balance wheels 75 may be positioned along the shaft 30 on either side of the screen box 20 to dynamically balance the screen assembly 10. In one embodiment, as best shown in FIG. 2A, the balance wheels 75 may be secured to each end of the shaft 30 between the bearings 65, 70. The centrifugal force of the rotating balance wheels 75 creates the circular motion of screen box 20 and a circular motion of bearings 70. To minimize the vibrations reaching the base 80, the circular motion of the bearing 70 is offset 180 degrees from the circular motion of the screen box 20 by the opposite eccentricities of the shaft journals 55 and 60. It is understood that the balance wheels 75 may be made from any material, such as steel, and may have adjustable weights so as to provide proper balancing.

Figure 2B:
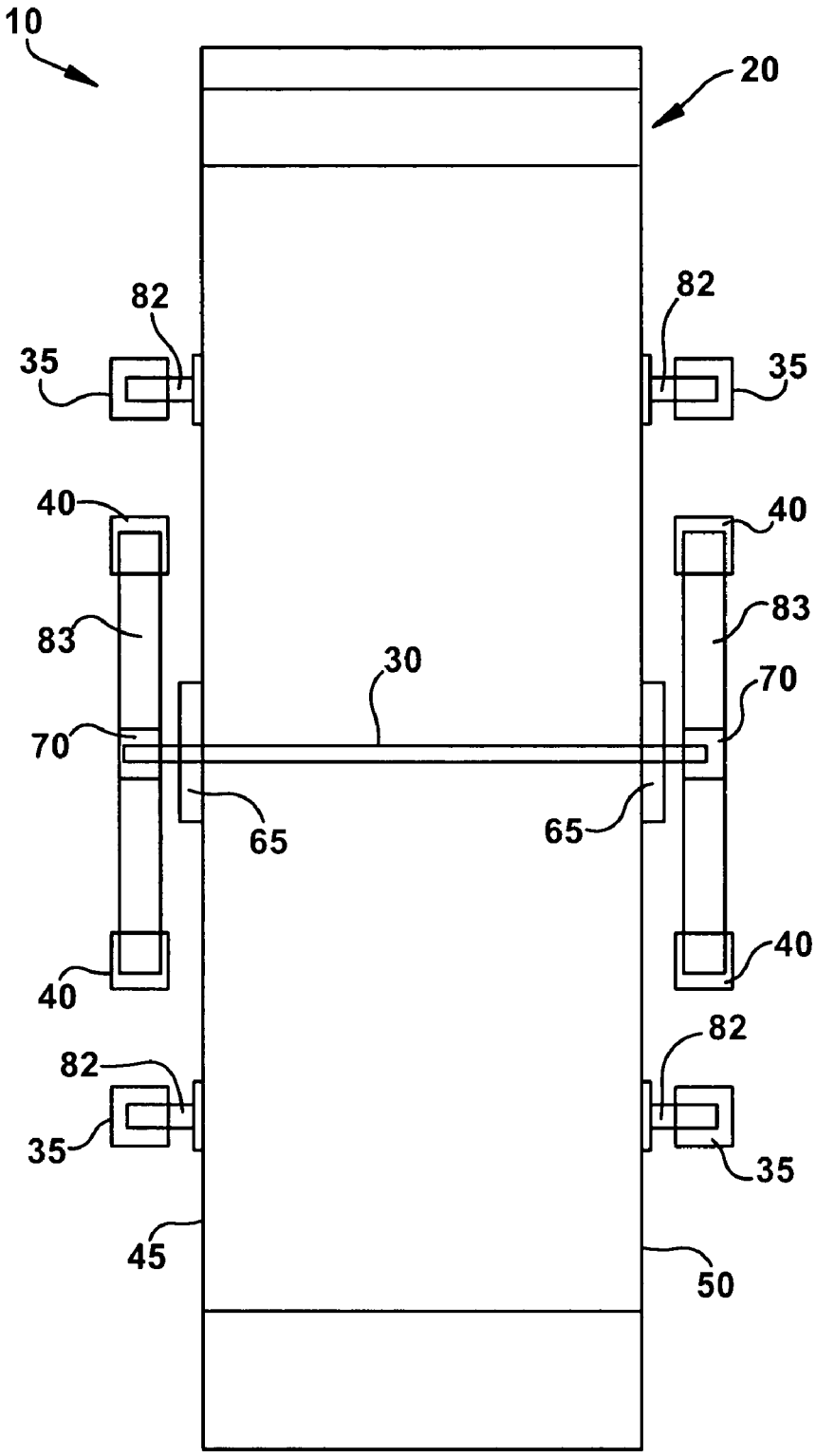
FIG. 2B is top view of FIG. 2A.

As best shown in FIG. 1, the screen box 20 is suspended by at least one articulated suspension assembly 35. As shown in FIGS. 1 and 2B, suspension assembly 35 may be secured to brackets 82 that extend substantially perpendicularly outward from side walls 45, 50. In addition, at least one suspension assembly 40 may be secured to bearing supports 83, which are separate from the screen box 20. The resulting configuration allows for free-floating action of the screen box 20 and permits the shaft 30 to find its natural center of rotation without placing strain or thrust on the bearings 65, 70. As shown in FIG. 1, the articulated suspension assembly 35, 40 may be secured to a common base 80. It is understood that in some embodiments, the base 80 may be a supporting structure 85, such as the floor. Further, as shown in FIG. 1, the screen assembly 10 may be installed at an angle. In one embodiment, the screen assembly 10 may be installed at an angle of up to about 25 degrees.

Figure 4:
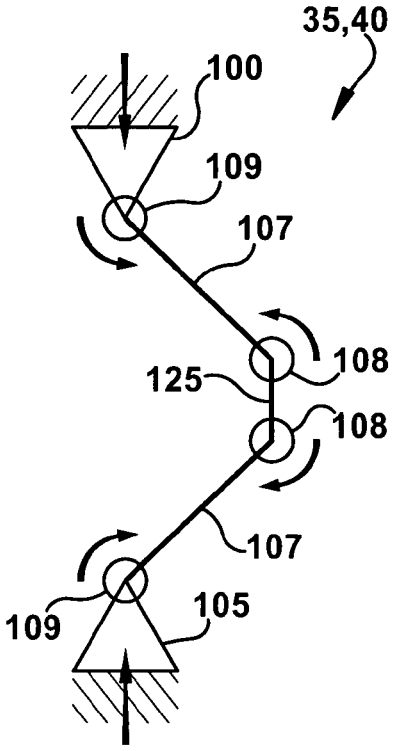
FIG. 4 is a schematic view of an articulated suspension assembly in an embodiment of the present invention.

FIG. 4 shows a schematic view of one embodiment of the articulated suspension assemblies 35, 40. The articulated suspension assemblies 35, 40 may have an assembly of arms (or legs) 107, each arm 107 having torsion joints 108, 109 capable of dampening vibrations. The arms 107 may be interconnected via a linkage (or leg) 125 at the torsion joints 108. In some embodiments, the arms 107 may be secured directly to machinery and the base 80 at torsion joints 109. In other embodiments, the arms 107 may also be secured to top and bottom base members 100, 105 at the torsion joints 109. Top and bottom base members 100, 105 provide convenient platforms for securing (and removing) suspension assemblies 35, 40 to machinery components. As shown in FIG. 3, brackets 82, 83, may be secured to the top base member 100 and base 80 may be secured to the bottom base member 105.

Figure 5:
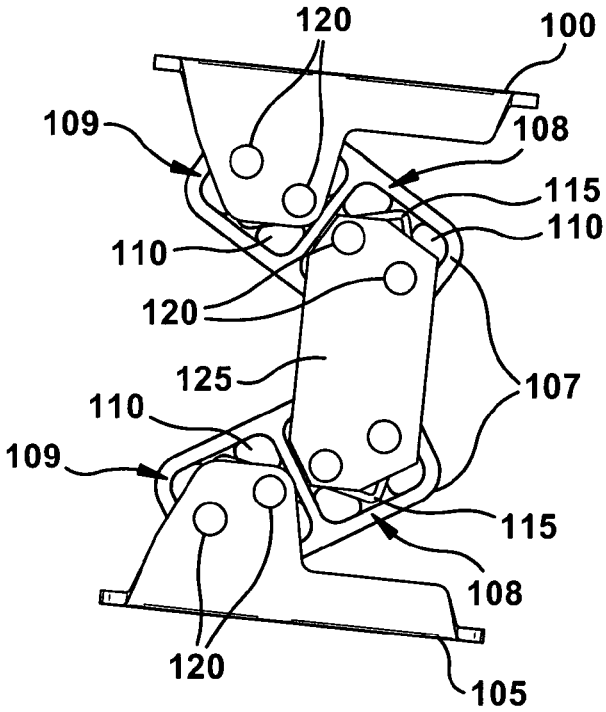
FIG. 5 is a side view of the articulated suspension assembly in an embodiment of the present invention.
Figure 6:
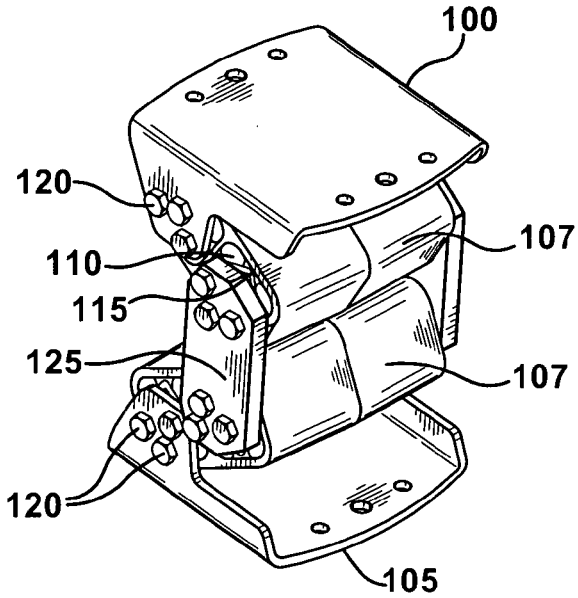
FIG. 6 is a top and side perspective view of the articulated suspension assembly.

FIGS. 5, 6 show an exterior side view of one embodiment of the articulated suspension assemblies 35, 40. In such an embodiment, the torsion joints 108, 109 may have four rubber members 110 positioned about a core 115 such that the core 115 is not in contact with the joint housing (inside arm 107). In one embodiment, the core 115 may have a square shape. As illustrated in FIG. 5, the top base member 100 and bottom base member 105 are secured to the core 115 (of joints 109) with pins or bolts 120. Linkage 125 may be secured to the core 115 (of joints 108) with one or more pins or bolts 120 to create an articulated linkage such that relative movement transferred from the screen box 20 and outside bearings 70 to base member 100 is dampened. It is understood that arms 107, base members 100, 105, and the core 115 may be made of any rigid material such as aluminum. In a preferred embodiment, the suspension assembly 35, 40 is of the type supplied by ROSTA AG, Hauptstrasse 58, CH-5502 Hunzenschwil, manufactured under the name ROSTA Type AB-D. It is understood, however, that the torsion joints 108, 109 should not be deemed as limited to any specific shape, type, or configuration. One of ordinary skill in the art will appreciate the use of various shapes, types, and configurations of torsion joints 108, 109. Illustrative examples may include torsion springs, gas cylinders, and single elastomoric members with and without a core 115.

Turning now to the screen assembly 10, an example of how to use the screen assembly 10 as illustrated in FIGS. 1-7 is set forth below. A motor 63 coupled to shaft 30 may be energized to rotate the shaft 30. Accordingly, the eccentric rotation of the shaft 30 vibrates the screen box 20. The balance wheels 75 counterbalance the shaft 30 so as to generate the positive circle-throw motion of the screen box 20, as well as the circular motion of the bearings 70. Therefore, as material is fed at feed end 78 (as shown in FIG. 3) and is placed upon the screen medium 53, the vibration causes material smaller than the predetermined size to fall through the openings of the screen medium 53 so as to separate the smaller material from the larger material. The larger material is conveyed across the screen medium 53 by the circle-throw action and is discharged at a location separate from the discharge location of the smaller material. The circle-throw action makes it possible for the screen assembly 10 to both convey and screen the material in a continuous manner.

Figure 7A:
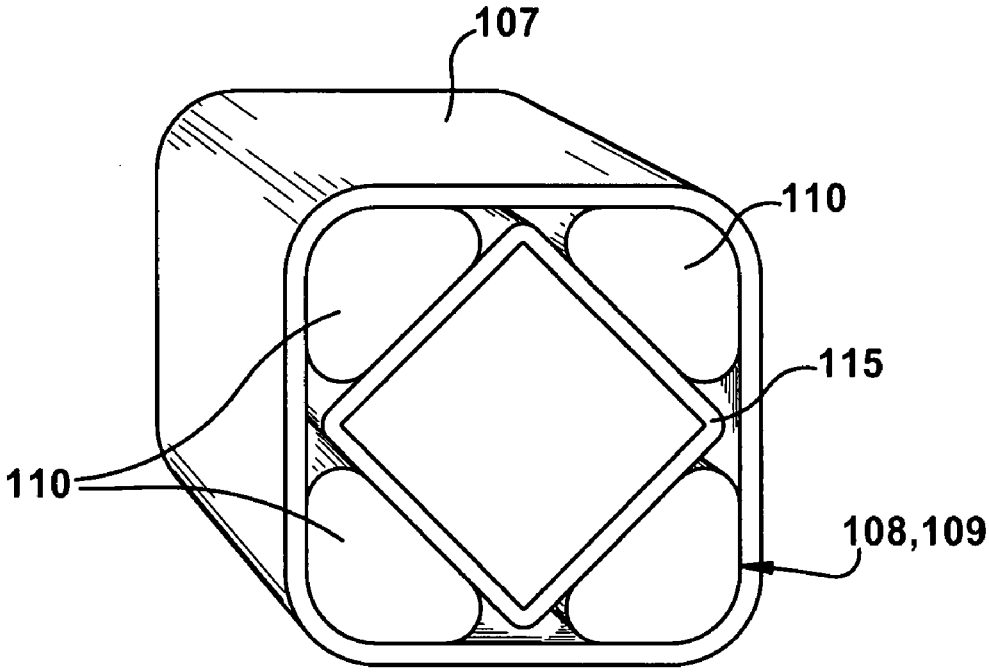
FIG. 7A is a partial view of a torsion joint in a first position in an embodiment of the present invention.
Figure 7B:
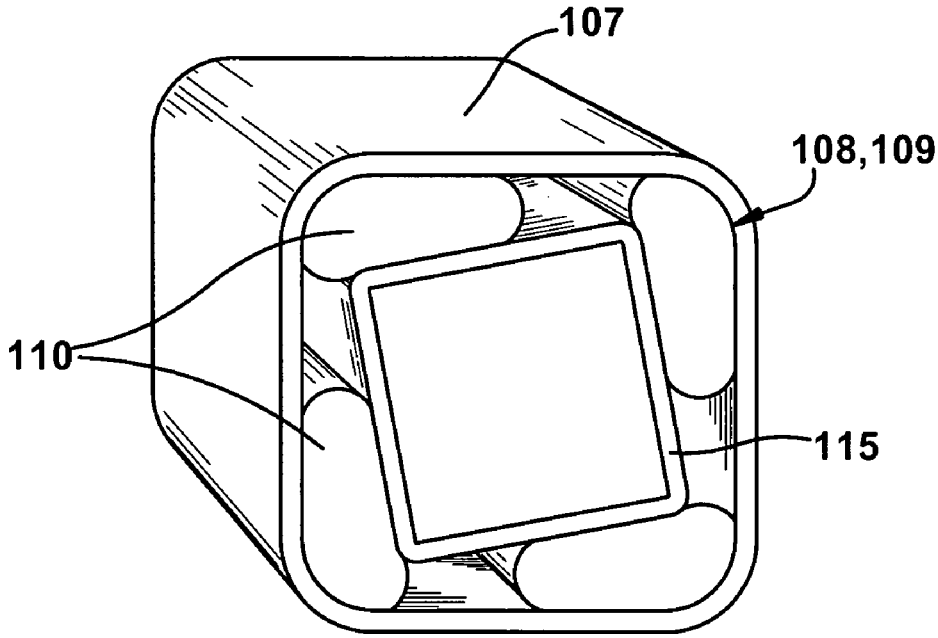
FIG. 7B is a sectional view of a torsion joint in a second position in an embodiment of the present invention.

The combination of the articulated suspension assemblies 35, 40 with a suspended eccentric screen provides an unique suspension system, which combines the functionality of springs, dampers, and bearings. As shown in FIG. 4, as vibration occurs, forces are applied collinearly to both ends of the suspension assemblies 35, 40. In some embodiments, as shown in FIGS. 4, 7A, and 7B, the collinear forces are transferred via arms 107 to core 115 in torsion joints 108, 109, thereby causing the core 115 to pivot and impart shear to the rubber inserts 110. The resulting molecular friction within the rubber inserts 110 in turn creates reaction forces similar to a spring, thereby dampening the vibration.

In addition, due to the free-floating configuration of the screen box 20 and the 180 degree offset of the journals 55, 60, the dynamic reaction forces resulting from the circular motion of the screen box 20 are directionally opposite to the dynamic reaction forces of the bearings 70. Therefore, the dynamic reaction forces acting on suspension assemblies 35, 40 cancel each other out, thereby allowing no substantial dynamic reaction forces to be transmitted from the base frame 80 to the supporting structure 85.

Accordingly, use of the articulated suspension assemblies 35, 40 with a suspended double eccentric screen box 20 provides spring rates with lower tolerances than those of shear rubber mounts and increases the accuracy of the suspension system, which in turn extends the life of machinery components such as the shaft 30 and bearings 65, 70. The overall dimensions of the articulated arm suspension assemblies 35, 40 are smaller than the commonly-used shear rubber mounts, thereby decreasing the vertical clearance necessary to install the screen assembly 10. Additionally, the top and bottom base members 100, 105 provide a less complicated design, allowing for easy installation and removal of the suspension assemblies 35, 40.

The invention has been described above and, obviously, modifications and alternations will occur to others upon the reading and understanding of this specification. The claims as follows are intended to include all modifications and alterations insofar, as they come within the scope of the claims or the equivalent thereof.

We claim:

1. A screen assembly for separating material according to particle size, said screen assembly comprising:

a base;

a screen box having at least one screen medium secured thereto and a pair of mutually opposed bearings thereon;

a shaft having a first pair of eccentric journals that are rotatably supported in the respective pair of mutually opposed bearings and a second pair of eccentric journals positioned outside of said screen box, said shaft rotatable about its axis to vibrate said screen box;

at least one articulated suspension assembly comprising:

a first leg having a first torsion joint and a second torsion joint;

a second leg having a third torsion joint and a fourth torsion joint; and a third leg having a first end pivotably secured to said second torsion joint and a second end pivotably secured to said third torsion joint;

wherein said at least one articulated suspension assembly pivotally interconnects said screen box and said base so that said first torsion joint is pivotally secured to said screen box and said fourth torsion joint is pivotally secured to said base to dampen vibrations acting upon said screen box so that substantially no vibrational forces are transmitted to said base.

2. A screen assembly according to claim 1, further comprising at least one second articulated suspension assembly pivotally interconnecting said shaft and said base so that said first torsion joint is pivotally secured to said shaft and said fourth torsion joint is pivotally secured to said base to dampen vibrations acting upon said shaft so that substantially no vibrational forces are transmitted to said base.

3. A screen assembly according to claim 1, wherein said first pair of eccentric journals are offset from said second pair of eccentric journals by about 180 degrees.

4. A screen assembly according to claim 3, further comprising a second pair of bearings associated with said second articulated suspension assembly for rotatably supporting said second pair of eccentric journals.

5. A screen assembly according to claim 4, further comprising a pair of masses secured to said shaft to act as a fly wheel.

6. A screen assembly according to claim 5, wherein said pair of masses are positioned between said screen box and said second pair of bearings.

7. A screen assembly according to claim 6, wherein said torsion joints are housed in said first and second legs and comprise a core pivotably secured by a plurality of rubber inserts surrounding said core, said plurality of rubber inserts capable of dampening vibrational forces transmitted to said core.

8. A screen assembly according to claim 7, wherein said first, second, and third legs and said core are made of metal.

9. A screen assembly according to claim 8, wherein said first pair and said second pair of bearings are spherical roller bearings.

10. A screen assembly according to claim 9, wherein said screen box is installed at an angle up to about 25 degrees.

11. A screen assembly according to claim 10, wherein said screen box has at least one screen deck supporting said screen medium.

12. A screen assembly according to claim 11, wherein said screen medium defines an array of sieve-like openings of a predetermined size for allowing material up to a predetermined size to pass through said screen medium

13. A screen assembly according to claim 12, wherein said screen medium is a woven cloth.

14. A screen assembly according to claim 13, wherein said shaft is rotated by a motor.

15. A screen assembly according to claim 14, wherein said motor is secured to said base.

* * * * *